US008677927B2

(12) United States Patent
Yang

(10) Patent No.: US 8,677,927 B2
(45) Date of Patent: Mar. 25, 2014

(54) COATING HEAD AND COATING APPARATUS USING THE SAME

(75) Inventor: Szu-Nan Yang, New Taipei (TW)

(73) Assignee: Prologium Technology Co., Ltd., New Taipei (TW)

( * ) Notice: Subject to any disclaimer, the term of this patent is extended or adjusted under 35 U.S.C. 154(b) by 333 days.

(21) Appl. No.: 13/094,726

(22) Filed: Apr. 26, 2011

(65) Prior Publication Data

US 2012/0097096 A1 Apr. 26, 2012

(30) Foreign Application Priority Data

Oct. 26, 2010 (TW) ..... 99136498 A

(51) Int. Cl.
*B05C 5/02* (2006.01)
*B05C 5/00* (2006.01)
*B05C 11/10* (2006.01)

(52) U.S. Cl.
CPC ..... *B05C 5/02* (2013.01); *B05C 5/0258* (2013.01); *B05C 11/1034* (2013.01); *B05C 11/1047* (2013.01)
USPC ..... 118/300

(58) Field of Classification Search
None
See application file for complete search history.

(56) References Cited

U.S. PATENT DOCUMENTS

| | | | | |
|---|---|---|---|---|
| 5,591,266 | A * | 1/1997 | Osawa et al. | 118/410 |
| 5,628,827 | A * | 5/1997 | McCollam et al. | 118/695 |
| 2002/0015619 | A1 * | 2/2002 | Stephens | 405/129.3 |
| 2008/0128082 | A1 * | 6/2008 | Masuda et al. | 156/293 |

* cited by examiner

*Primary Examiner* — Dah-Wei D Yuan
*Assistant Examiner* — Jethro Pence
(74) *Attorney, Agent, or Firm* — McClure, Qualey & Rodack, LLP

(57) ABSTRACT

The invention discloses a coating apparatus for coating slurry on a substrate. The coating apparatus comprises: a container for storing the slurry; a slurry pushing means connecting with the container through a discharging pipe; a coating head connecting with the slurry pushing means through another discharging pipe and connecting with the container through a feed-back pipe, and a controlling valve provided within the feed-back pipe. The coating head comprises: a coating slit; a discharging concave; a feed-back concave; a separator provided between the feed-back concave and the discharging concave; and an extending concave for correspondingly covering and matching with the discharging concave and the feed-back concave. The discharging concave and the feed-back concave are respectively provided with a discharging aperture and a feed-back aperture for respectively connecting with the discharging pipe and the feed-back pipe.

10 Claims, 6 Drawing Sheets

COATING HEAD AND COATING APPARATUS USING THE SAME

FIELD OF THE INVENTION

The present invention relates to a coating head and a coating apparatus using the same.

BACKGROUND OF THE INVENTION

In the field of technology for equally coating slurry as a thin film, it has been known a variety of coating methods such as a die coating, a spin coating, a roller coating, etc. However, the method of the spin coating may cause the problem of uneven thickness, i.e., thicker in center area, when the gravity weight of the slurry exceeds over a specific range. On the other hand, the roller coating is more suitable for coating continuously. In general, the die coating may be suitable for coating continuously or discontinuously.

The apparatus for coating die is referred to as a die coating apparatus. Referring to FIG. 5 and FIG. 6, the die coating apparatus generally is provided with a container 101 for storing coating slurry; a pump 102 connected to the container 101 through a first pipe 103; a coating head 105 connected to the pump 102 through a second pipe 104; and a first valve 106 provided between the pump 102 and the coating head 105 through the second pipe 104; a third pipe 107 and a third valve 110 provided between the coating head 105 and the container 101; an elevator mechanism 112, connected to the coating head 105, for controlling the distance between the coating head 105 and the substrate 120; and a second valve 109 connected between the container 101 and the second pipe 104 through a fourth pipe 108. The coating head 105, which is for coating the slurry on a substrate 120, is almost placed horizontally, and thus this kind of coating is generally referred to as a horizontal coating.

To observe the detailed configuration of the coating head 105 of the prior coating apparatus and the coating mechanism, as shown in FIG. 5 and FIG. 6, the interior of the coating head 105 has a discharging concave 1051 and a feed-back concave 1052, wherein the discharging concave 1051 has an discharging pipe 1055 connected to the second pipe 104. The feed-back concave 1052 has a feed-back pipe 1056 connected to the third pipe 107. The radical size of the discharging concave 1051 and the feed-back concave 1052 are the same. Further, the discharging pipe 1055 and the feed-back pipe 1056 are provided in parallel.

The coating steps thereof are described as follows. First, the protective cover (not shown) is covered on the front end P of the coating head 105 to avoid the slurry flowing therefrom. The pump 102 is then started. The first valve 106 and the third valve 110 are opened, and the second valve 109 is closed simultaneously, so as to fulfill the first pipe 103, the second pipe 104 and the third pipe 107 with the coating slurry to thus eliminate the gas bubbles which may be existed within those pipes. Then, the operation of coating is to proceed. The protective cover is removed, and the elevator mechanism 112 is operated to move the coating head 105 toward the substrate 120 within a predetermined distance. The third valve 110 is then closed and the second valve 109 keeps closed. The coating slurry is thus coated on the substrate 120 only through the path in an order of the first pipe 103, the second pipe 104, the first valve 106, and the coating head 105.

Herein as an example, referring to FIGS. 5 and 6, it is illustrating a die coating apparatus that operating coating on a flexible substrate 120, which is longer in length. The flexible substrate 120 is wound around between a discharging shaft R and a feed-back shaft Rw. The flexible substrate 120 is moved upward and downward by the rotation of the discharging shaft R, the feed-back shaft Rw, and a roller R1, R2 provided therebetween. The flexible substrate 120 is thus applied by an appropriate force to allow a flat coating position, i.e., the flat position around the coating head 105, and to have the slurry uniformly coated on the substrate 120 in an operation of continuous coating.

When it is about to stop discharging slurry from the coating head 105, the third valve 110 is kept closed, and the first valve 106 is closed and the second valve 109 becomes open, so as to recycle the slurry through path from the first pipe 103, the second pipe 104, and the fourth pipe 108, to the container 101. At the moment when the first valve 106 is closed, a phenomenon of tiny vacuum happens between the first valve 106 and the coating head 105, and thus it generates a pulling force for the slurry existing in the coating head. Further, in view of micro perspective, a viscous force happens among the slurry, and thus it prevents the slurry from dropping from the coating slit 1057.

However, it is very difficult to control the magnitude of the pulling force and the viscous force. The aperture diameter of the coating slit 1057 is much smaller than that of the discharging concave 1051 and the feed-back concave 1052. Thus, the slurry residual in the coating slit 1057 is not easy to be out of the coating slit 1057, so the residual slurry still exists in the coating slit 1057. Consequently, the slurry still continues flowing from the coating head 105 after the first valve 106 is closed.

On the other hand, as can be observed from the above content, the slurry in the coating head 105 and a portion of the third pipe 107 proximate to the coating head 105 is in a still state after the first valve 106 is closed. The slurry is allowed to flow only if overcoming a static frictional force existing in the coating head 105 and the third pipe 107. It is well-known that a static frictional force is always larger than a dynamic frictional force. In other words, an applied force overcoming a static frictional force will be too large in view of the dynamic frictional force. Accordingly, in the prior art, slurry which starts to be pushed by the pump 102 is too much, and it causes the slurry to be pushed thereafter is disadvantageously too big in size. That is, the starting portion and the ending portion of the coating pattern coated on the substrate 120 are in shape of convex as shown in FIG. 5 and FIG. 6, which are not in even and flat shape as required.

Hereinafter, we consider another coating method naming vertical coating. When the substrate is not flexible and is not wound for being horizontally coated with slurry as shown in FIG. 5 and FIG. 6, the substrate 120, positioned below the coating head 105, moves toward a specific direction. The coating head 105 coats the slurry on the substrate 120 in a perpendicular manner. In considering the period that the coating head 105 starts discharging slurry and stops discharging slurry, or the period that the slurry is re-discharging from the state of stop discharging slurry, it is found the viscous force within the slurry itself is comparative small since the slurry contains a large percentage in a range about within 40% to 70% of solid material. Moreover, since the weight of slurry causes a major affect, the phenomenon that the slurry residual within the coating slit 1057 becomes more serious. Thus, the phenomenon as described that "slurry which starts to be pushed by the pump 102 is too much, and it causes the slurry to be pushed thereafter is disadvantageously too big in size" becomes more serious. More, the residual slurry is unable to be restore and fed back completely, which is still survived in the coating head 105, as shown in FIG. 6. The residual slurry becomes very easy to drop on the substrate 120. It causes the drawbacks that the patterns on the substrate 120 are not expected, or that a thickness of a specific portion on the substrate 120 is much thicker than requested. The above drawbacks both cause the reasons of generating a flaw substrate. The removal of the slurry residual on the front end of the coating head 105 also further causes a waste of slurry. For the sake of the above, a coating apparatus with the above structure is generally used for horizontal coating. Furthermore, the drawbacks can only be overcome by cutting the uneven portion or the portion which belongs to a flaw pattern.

Besides, regardless the continuation coating, discontinuation coating, or coating on a wound substrate with a longer size, although the distance between the coating head and the substrate is adjusted by applying the elevator mechanism, or the thickness of slurry is controlled by adjusting the forward speed of the substrate by utilizing the rotating device such as rotating shaft R, however, it only can perform the operation of coating with a simple rectangular shape. In other words, the goal that generates a variety of shapes could not be achieved.

Thus, it becomes an important issue about how to remove the slurry from the coating slit 1057 of the coating head 105, or even remove the slurry from the discharging concave 1051 when stopping coating. It also becomes an issue about how to recycle the slurry residual in the coating head 105 in view of situation it provides an excellent expected pattern with uniform and even thickness, and prevents the waste in material of slurry and substrate.

SUMMARY OF THE INVENTION

In order to overcome the drawbacks that "slurry which starts to be pushed by the pump 102 is too much, and it causes the slurry to be pushed thereafter is disadvantageously too big in size" and the problem of uneven coating and unexpected coating pattern, the present invention provides a coating apparatus, which prevents the above drawbacks by guiding the slurry in the coating slit to move toward the feed-back pipe. It also achieves the goal of complete recycle of slurry, by which the residual slurry will not unexpected drop from the coating head to the substrate. The coating apparatus comprises: a container for storing the slurry; a slurry pushing means connecting with the container through a discharging pipe; a coating head connecting with the slurry pushing means through another discharging pipe and connecting with the container through a feed-back pipe, and a controlling valve provided within the feed-back pipe. The coating head comprises: a coating slit; a discharging concave; a feed-back concave; a separator provided between the feed-back concave and the discharging concave; and an extending concave for correspondingly covering and matching with the discharging concave and the feed-back concave. The discharging concave and the feed-back concave are respectively provided with a discharging aperture and a feed-back aperture for respectively connecting with the discharging pipe and the feed-back pipe.

In an embodiment of the present invention, the coating head is a built-up coating head, which is formed by combining two pieces of combining elements. A pad is further provided between two pieces of combining elements to adjust the width of the slurry coated on the substrate. In an embodiment, the slurry driving mechanism is a screw pump, an air pressure pump or a gear pump. The thickness of the slurry coated on the substrate is adjustable by adjusting the pushing force of the slurry pushing means.

In an embodiment of the present invention, an axial angle between the discharging aperture and the feed-back aperture of the coating head is in the range between 1° and 90°.

In an embodiment of the present invention, two pieces of the combining elements are locked fixedly with each other by a fixing screw.

In an embodiment of the present invention, the discharging aperture is provided below the discharging concave.

In an embodiment of the present invention, an aperture diameter of the coating slit is smaller than the length distance between the separator and the extending concave.

DETAILED DESCRIPTION OF THE PREFERRED EMBODIMENTS

Figure 1:
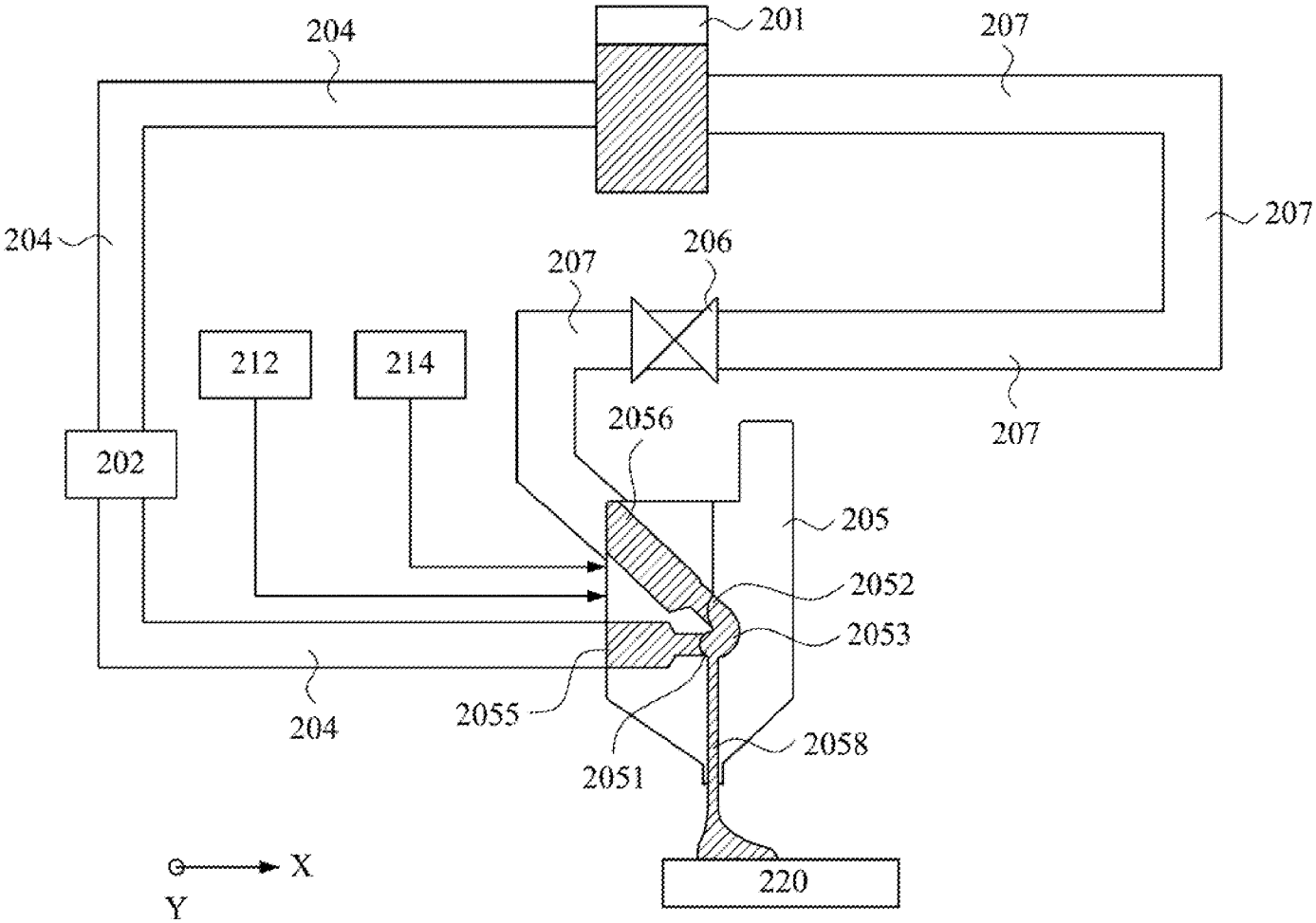
FIG. 1 is a perspective view of the coating apparatus in a coating state of the present invention.
Figure 2:
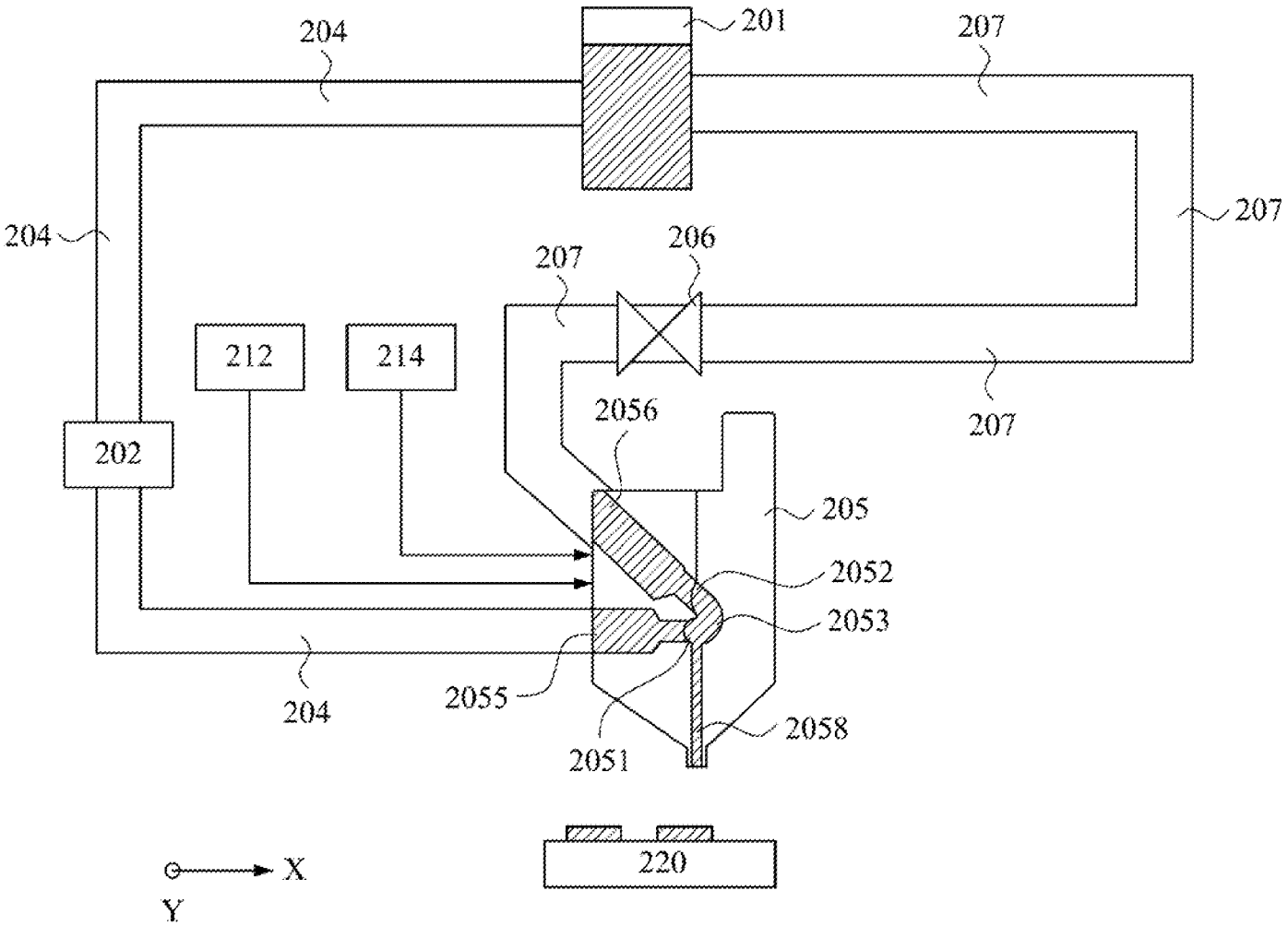
FIG. 2 is a perspective view of the coating apparatus in a recycling state of the present application.

Please refer to FIG. 1 and FIG. 2, which are perspective views of the coating apparatus in the present invention. The coating apparatus comprises: a container 201 for storing slurry; a slurry pushing means 202 connecting with the container 201 through a discharging pipe 204; a coating head 205 connecting with the slurry pushing means 202 through another discharging pipe 204 and connecting with the container through a feed-back pipe 207, and a controlling valve 206 provided within the feed-back pipe 207. The slurry pushing means 202 is a screw pump, an air pressure pump, or a gear pump. A diameter of the feed-back pipe 207 is larger than that of the discharging pipe 204. The coating head 205 could connect to an positioning means, such as a first direction positioning means 212 and a second direction positioning means 214 for individually controlling the coating head 205 in a first direction and a second direction to position corresponding position relationship with the substrate 220. The substrate 220 is provided with positioning points, which is not shown in the figures. The positioning means further control the coating head 205 to move in a path in relation with the substrate 220 from the coating starting point to the ending point, and the speed thereof. In above, the first direction and the second direction are vertical to each other.

In the present embodiment, the first direction and the second direction are X-axis and Y-axis respectively, as shown in the figures. Since the present invention is advantageous in that the slurry in the coating slit is guiding toward the feed-back pipe, no matter the coating head moves from the ending point to the next starting point, or return to the standby point, it is found that the slurry is absolutely not drop out. In spite that in the present embodiment the positioning means are two-direction positioning means, which are X and Y directions, it is not limited to this. To a person having ordinary skill in the art can realize the positioning means includes: single direction positioning means, such as either one of X, Y, Z directions; triple direction positioning means, such as all of X, Y, Z directions; and other directions positioning means. The X direction positioning means and Y direction positioning means are for controlling the pattern generation on the substrate, and Z direction positioning means are for controlling the spacing between the coating head 205 and the substrate 220. In other words, the positioning means are for controlling the moving path and the speed of the coating head 205, and the thickness of the slurry.

Figure 3:
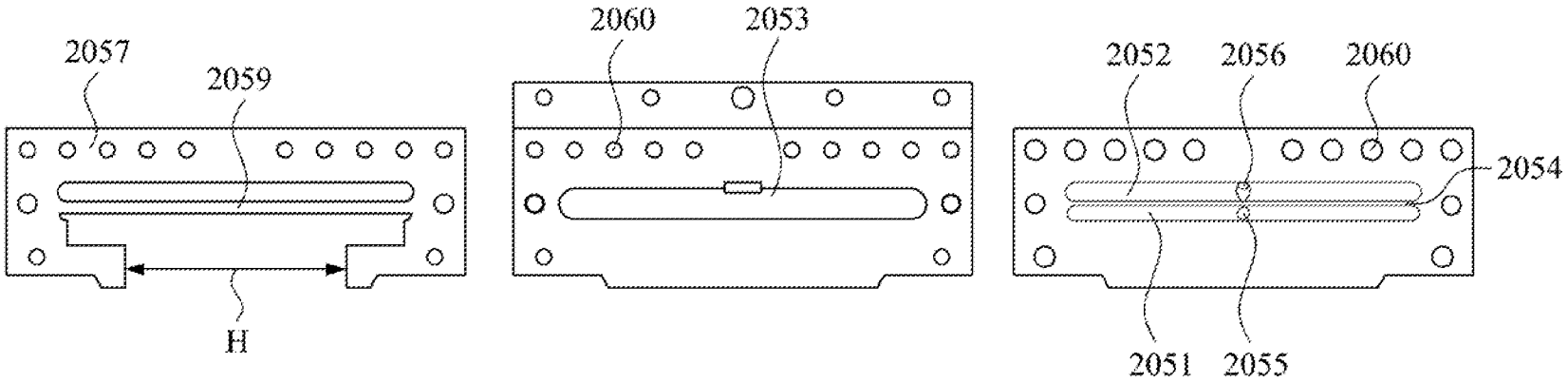
FIG. 3 is a perspective view of coating head in one embodiment of the present invention.
Figure 4:
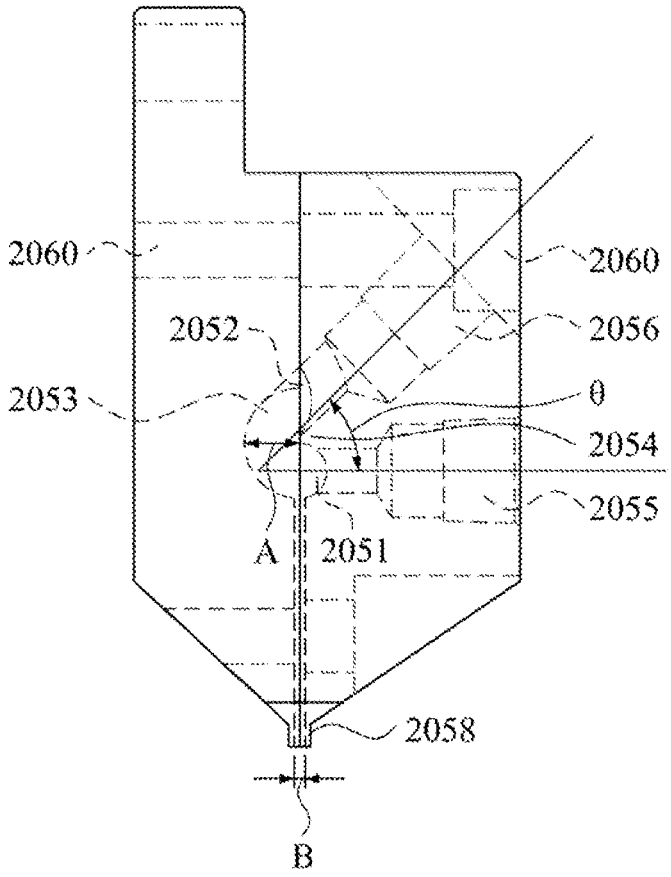
FIG. 4 is a perspective view of the coating head in accordance with FIG. 3.
Figure 5:
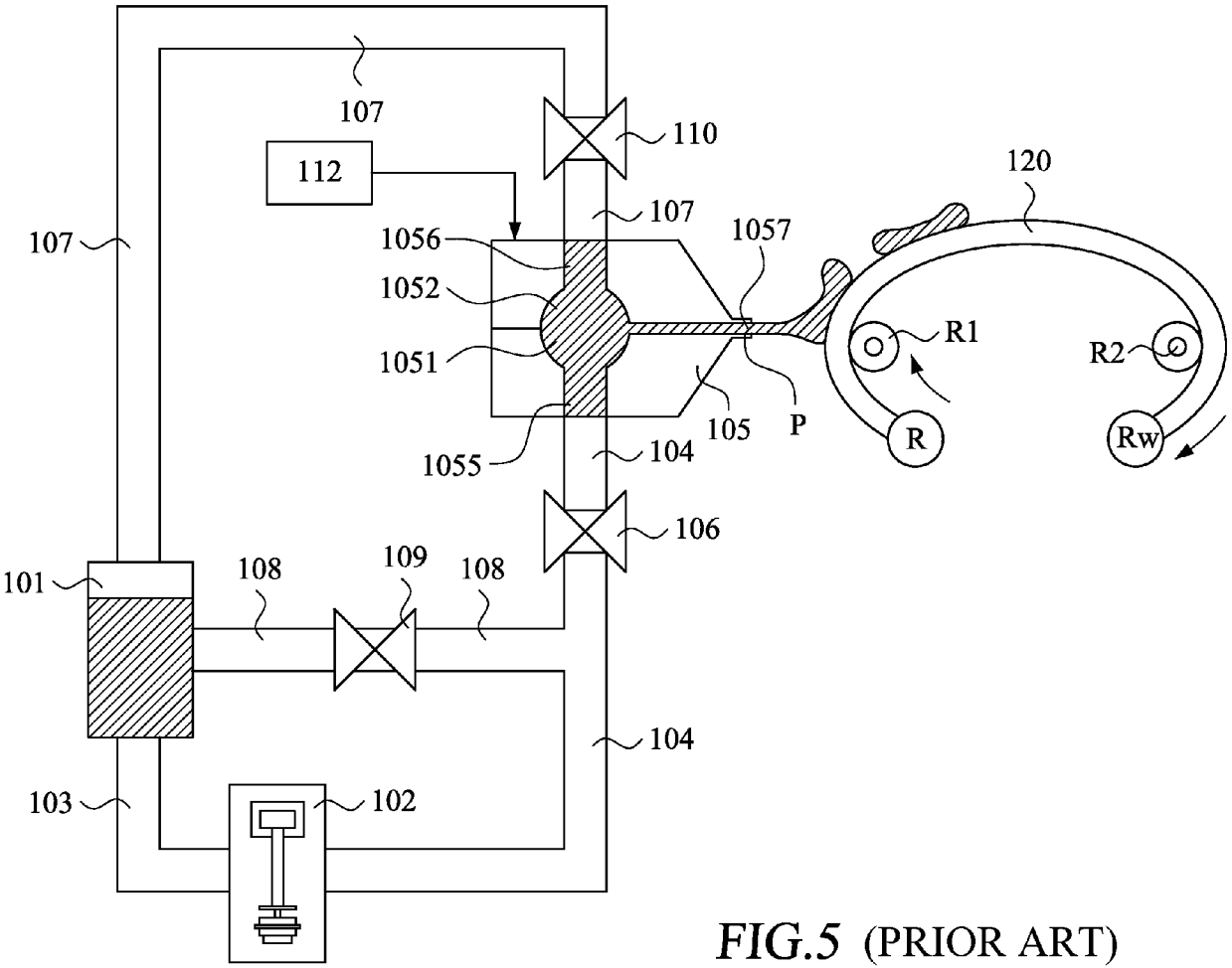
FIG.5 (PRIOR ART)
FIG. 5 is a perspective view of the coating apparatus in a coating state of a prior art.
Figure 6:
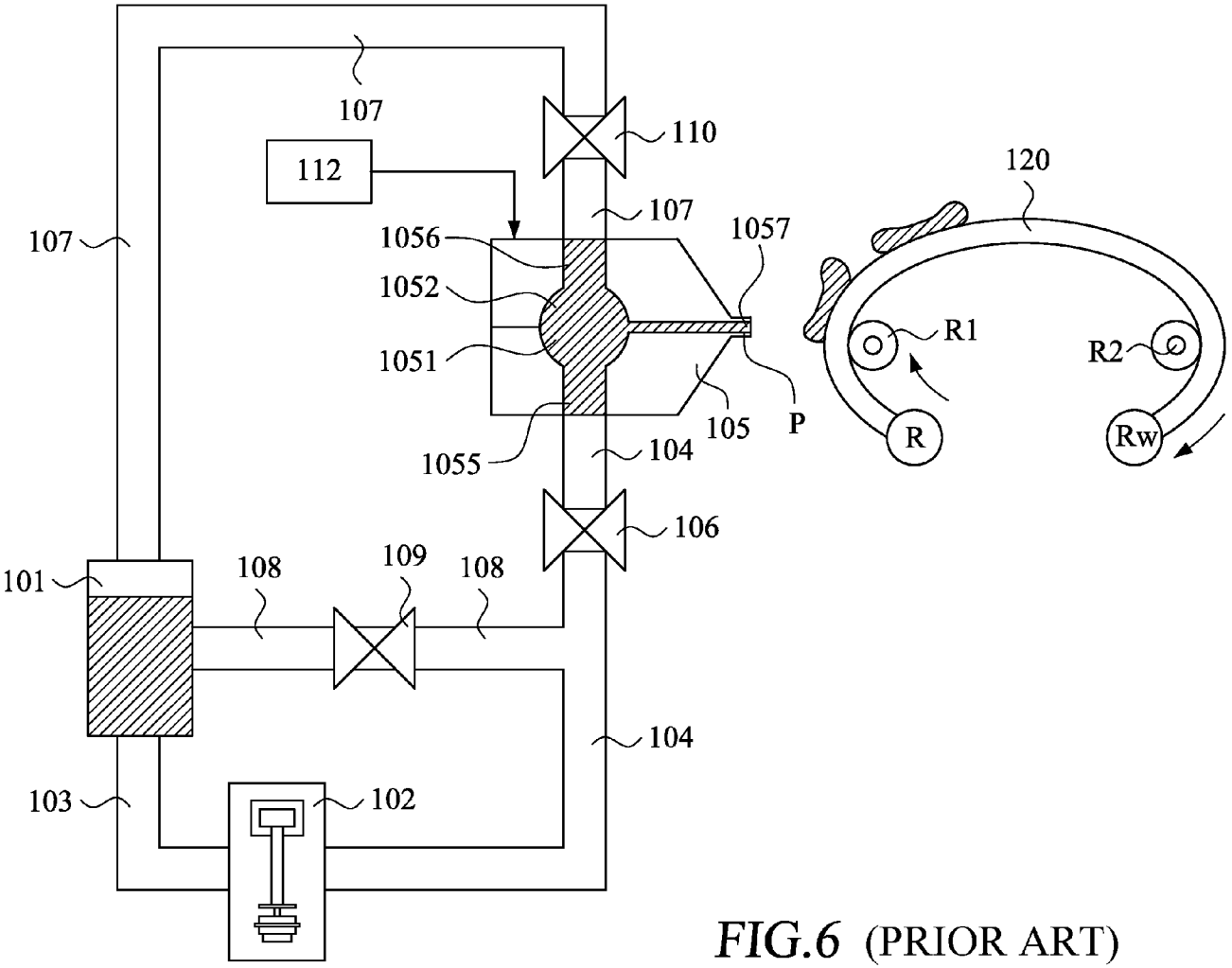
FIG.6 (PRIOR ART)
FIG. 6 is a perspective view of the coating apparatus in a recycling state of a prior art.

Please refer to FIG. 3 and FIG. 4, which respectively represents the coating head before and after being assembled. The coating head 205 comprises: a coating slit 2058, a discharging concave 2051, a feed-back concave 2052, a separator 2054 provided between the discharging concave 2051 and the feed-back concave 2052, and an extending concave 2053 for correspondingly covering and matching with the discharging concave 2051 and the feed-back concave 2052. Preferably, an aperture diameter B of the coating slit 2058 is smaller than the length distance A between the separator 2054 and the extending concave 2053, as referring in FIG. 4. And an inner diameter of the feed-back concave 2052 is larger than an inner diameter of the discharging concave 2051, so the internal pressure of the feed-back concave 2052 is smaller than the internal pressure of the discharging concave 2051. It thus ensures the slurry to flow back to the feed-back end. The separator 2054 is used for preventing from flow interference between different flows. The discharging concave 2051 and the feed-back concave 2052 are respectively provided with a discharging aperture 2055 and a feed-back aperture 2056 for respectively connecting with the discharging pipe 204 and the feed-back pipe 207. Preferably, an aperture diameter of the feed-back aperture 2056 is larger than an aperture diameter of the discharging aperture 2055. Further, in the other embodiment, it provides plural discharging apertures and plural feed-back apertures for equally coating the slurry.

In the present embodiment, the coating head 205 is formed by combining two pieces of combining elements. The separator 2054 is integrally molded with one piece of combining element. The extending concave 2053 is integrally molded within another piece of combining element. In FIG. 3, a ⊓-shaped pad 2057 is provided between two pieces of combining elements, in which a spacer 2059 is adjacent with the separator 2054. The width of the thin film coated on the substrate 220 is adjustable by changing the pad 2057 with different spacing distance H, since the width of the coating thin film is actually the same as the spacing distance H of the ⊓-shaped pad 2057, and the spacing distance H is smaller than the width of the coating slit 2058. Two pieces of combining elements are locked together by a fixing element 2060, e.g. a screw. Of course, other two-piece combining elements are applicable by using such as a tenon a sliding track or any other match type fixing elements. Preferably, the discharging aperture 2055 is provided below the discharging concave 2051 to reduce a pushing force generated on the coating head 205. In FIG. 4, an axial angle θ between the discharging aperture 2055 and the feed-back aperture 2056 is in the range between 1° and 90°. That is, the discharging aperture 2055 and the feed-back aperture 2056 are not parallel provided with each other.

Referring again to FIG. 1 and FIG. 2, the operating procedures for the coating apparatus of the present invention is described as follows. First, the controlling valve 206 is kept open after the slurry pushing means 202 is operated, so that the coating slurry in the container 201 is equally distributed and fulfilled within the discharging pipe 204, the coating head 205 and the feed-back pipe 207 as well. The fulfilling phenomenon is for expelling the gas in the pipe. In the coating head 205 as shown in FIG. 4, the length distance A between the separator 2054 and to the periphery of the extending concave 2053 is larger than the aperture diameter B of the coating slit 2058. Moreover, the inner diameter of the extending concave 2053 is larger than the inner diameter of the discharging concave 2051. Therefore, the slurry will flow in the path from the extending concave 2053, the feed-back concave 2052, the feed-back aperture 2056, the feed-back pipe 207, and to the container 201, rather than flow through the coating slit 2058 to discharge on the substrate 220. Furthermore, the characteristics of the slurry may also be contributive to pull back the slurry residual in the coating slit 2058 to the extending concave 2053.

After that, it starts to perform the operation of coating as follows. The controlling valve 206 is turned off to prohibit the slurry from passing through the controlling valve 206. The coating head 205 is moved to the desire position and is moved on a fixed substrate 220 by utilizing the first direction positioning means 212 and the second direction positioning means 214. Consequently, the coating slurry is coated on the substrate 220 by flowing through the discharging pipe 204, the discharging aperture 2055, the discharging concave 2051 to the coating slit 2058. Thus, the thin film may be equally coated on the surface of the substrate 220.

When the coating is paused, the controlling valve 206 is turned on. Due to the difference of flow resistance as described above, the coating slurry is bound to flow in a path from the extending concave 2053, the feed-back concave 2052, the feed-back aperture 2056, the feed-back pipe 207, and to the container 201. If we observe the above, we can find that only the slurry in the coating slit 2058 is stirless and still, which is different from the situation found in the prior art that pull back the slurry by un-controllable vacuum force and viscous force.

The present invention actively pulls back the slurry by using the controllable slurry pushing means 202, such as a reversible axial pump. It thus ensures to avoid the situation that the coating slurry unexpectedly coating on the substrate 220 when the coating head 205 starts discharging slurry from its pause state. It therefore provides an excellent quality of pattern coated on the substrate 220 with precise thickness.

Furthermore, when the coating head 205 starts discharging slurry from its pause state, the controlling valve 206 is opened, it only needs to overcome the static friction force, which is significant smaller than the static friction force as needed in the prior art. Therefore, the slurry pushing means does not need to apply a very large force to push the slurry to coat on the substrate 220 through the discharging concave 2051 and the coating slit 2058.

By allocating the first direction positioning means 212 and the second direction positioning means 214 to move the coating head 205 and the timing sequence of the discharging operation thereof, the coating apparatus is allowed to form a sheet form, a strip form, a grating form, a geometrical form, an user-designed form or the combination thereof on the substrate 220. As compared with the prior art that the substrate is movable, the substrate 220 of the present invention is allowed to be fixed and not movable, and it only requires the coating head 205 to move on the substrate 220 without the risk that the slurry is flow messily. It also can apply the conventional grating for forming any type of patterns. The thickness of the coating slurry is adjustable by adjusting the pushing force of the slurry pushing means 202. That is, more slurry is pushed out if a larger pushing force is applied, and vice versa.

The coating apparatus provided in the present invention is advantageous in that the operation of coating and the operating to pause coating are achieved by controlling the on/off of only one valve. However, in the prior art, it requires the on/off of at least two valves to achieve said operations. The structure and convenience of the present invention is outstanding as compared with the prior art. The present invention can fully the problem of flaw coating that is not evitable by the prior art. The necessity of cutting the substrate is thus saved. The utilization percentages of substrates are enhanced. The present invention can fully recycle the slurry residual in the coating head 205 in the operation. The axial angle θ between the discharging aperture 2055 and the feed-back aperture 2056 is in the range between 1° and 90°, so the coating head 205 of the present invention is applicable for the horizontal or vertical coating apparatus. A person having an ordinary skill in the art can realize that although the above describes a movable coating heading moving on a fixed substrate, however the present invention is applicable for a movable substrate moving in correspondence to a fixed coating head, in which a substrate and a coating head move relatively to equally coat the slurry on the surface of the substrate. Furthermore, the present invention is especially applicable for slurry with high weight percentage, high viscidity, and high solid content.

What is claimed is:

1. A coating apparatus, comprising:

a container;

a coating head connecting with the container by a discharging pipe and a feed-back pipe;

a slurry pushing means provided within the discharging pipe; and a controlling valve provided within the feed-back pipe, wherein the coating head comprises:

a coating slit;

a discharging concave having a discharging aperture connecting with the discharging pipe;

a feed-back concave having a feed-back aperture connecting with the feed-back pipe, wherein an axial angle between the discharging aperture and the feed-back aperture of the coating head is in the range between 1° to 90°;

a separator provided between the discharging concave and the feed-back concave; and an extending concave provided in correspondence with the discharging concave and the feed-back concave.

2. The coating apparatus as claimed in claim 1, wherein an aperture diameter of the coating slit of the coating head is smaller than the length distance between the separator and the extending concave.

3. The coating apparatus as claimed in claim 1, wherein an inner diameter of the feed-back concave of the coating head is larger than an inner diameter of the discharging concave.

4. The coating apparatus as claimed in claim 1, wherein an aperture diameter of the feed-back concave of the coating head is larger than an aperture diameter of the discharging concave.

5. The coating apparatus as claimed in claim 1, wherein a pipe diameter of the feed-back concave is larger than a pipe diameter of the discharging concave.

6. The coating apparatus as claimed in claim 1, wherein the slurry pushing means is either one of a screw-type pump, an air pressure pump or a gear pump.

7. The coating apparatus as claimed in claim 1, wherein the coating head is a built-up coating head, which is formed by two pieces of combining elements.

8. The coating apparatus as claimed in claim 1, wherein the discharging aperture is provided below the discharging concave.

9. The coating apparatus as claimed in claim 7, wherein the built-up coating head further comprises: a pad provided between two pieces of combining elements.

10. The coating apparatus as claimed in claim 9, wherein the pad of the built-up coating head has a spacer provided adjacently to the separator.

* * * * *